United States Patent [19]

Donan, Jr. et al.

[11] 4,183,699

[45] Jan. 15, 1980

[54] WASHER/GASKET FOR MINE ROOF BOLT ASSEMBLY

[76] Inventors: David C. Donan, Jr., R.R. #1, - Rainwatee La., Manitou, Ky. 42436; David M. Donan, 1601 N. Leverett, Fayetteville, Ark. 72701

[21] Appl. No.: 907,112

[22] Filed: May 18, 1978

[51] Int. Cl.[2] ..... E21D 21/00

[52] U.S. Cl. ..... 405/259; 85/1 JP; 85/50 R; 85/63; 277/191

[58] Field of Search ..... 405/259, 260, 261; 85/1 JP, 50 R, 63; 277/190, 191

[56] References Cited

U.S. PATENT DOCUMENTS

| | | | |
|---|---|---|---|
| 769,684 | 9/1904 | Garlock | 277/191 |
| 2,235,078 | 3/1941 | Meisterhans | 85/50 R |
| 2,666,354 | 1/1954 | Dim et al. | 85/1 JP |
| 2,829,502 | 4/1958 | Dempsey | 405/261 |
| 3,326,004 | 6/1967 | Williams | 405/260 |

FOREIGN PATENT DOCUMENTS

| | | | |
|---|---|---|---|
| 2433875 | 2/1975 | Fed. Rep. of Germany | 85/1 JP |

*Primary Examiner*—David H. Corbin
*Attorney, Agent, or Firm*—Cahill, Sutton & Thomas

[57] ABSTRACT

An improved method and mine roof bolt assembly for sealing a roof bolt hole in a mine to reliably prevent ambient mine air from entering the roof bolt hole. The roof bolt assembly includes a support plate, a roof bolt extending through a hole in the support plate, a flexible washer/gasket for providing a reliable seal between the support plate and a portion of the mine roof surrounding the roof bolt hole and also providing a reliable seal to the roof bolt shaft. An expansion shell is attached to a threaded end of the mine roof bolt to anchor the mine roof bolt assembly in the roof bolt hole. The washer/-gasket includes an outer annular portion for providing a reliable seal between the mine roof and the support plate. The washer/gasket also includes a flexible inner annular portion for providing a reliable seal to the roof bolt shaft. The inner annular portion includes a relatively thin sphincter annulus which grips the roof bolt shaft to produce the seal therewith. A flexible interstitial annular washer having a tapered surface is disposed in an interior annular groove within the washer/gasket and is forced inwardly to grip the roof bolt shaft by compression of the washer/gasket as the roof bolt is tightened during installation of the roof bolt assembly, thereby producing tighter sealing to the roof bolt shaft.

6 Claims, 11 Drawing Figures

WASHER/GASKET FOR MINE ROOF BOLT ASSEMBLY

BACKGROUND OF THE INVENTION

1. Field of the Invention

The invention relates to mine roof bolt assemblies, and more particularly to flexible washer/gaskets for mine roof bolt assemblies for sealing the interior of mine roof bolt holes from mine air.

2. Description of the Prior Art

A variety of mine roof bolt assemblies are known in the art. They usually include a bolt of from three to six feet in length, a roof plate or support plate through which the roof bolt extends, and an expansion shell threaded onto a threaded end of the roof bolt. A mine roof bolt hole is drilled, usually perpendicularly to the surface of the mine roof, with the expansion shell inserted into the roof bolt hole such that the support plate abutts the mine roof. The roof bolt is tightened, causing the expansion shell to expand, thereby anchoring the entire assembly into the mine roof strata and forcing the support plate upwardly against the mine roof. The mine roof strata is known to be composed of various layers of different types of rock having varying strength characteristics. A plurality of spaced mine roof bolts installed in the mine roof tends to secure the various layers of mine roof strata together to prevent slippage therebetween, increasing the strength of the laminated strata, thereby preventing caving of the mine roof. However, up to now, the known mine roof bolt assemblies have not satisfactorily supported mine roofs wherein mine roof strata exposed by the roof bolt holes to ambient mine air and moisture has caused certain kinds of mine roof strata to weaken. Mine roof bolt assemblies are known to fall out of degraded roof bolt holes, eliminating the strata layer binding needed to prevent slippage between different layers of mine roof strata. It is also known that in certain cases a mine roof may collapse even though all of the mine roof bolts therein are sufficiently tightly anchored in a hard layer, such as limestone. Up to now, the cause of the later mentioned caving has not been well understood. U.S. Pat. No. 2,829,502 describes a mine roof bolt assembly for excluding mine air from a mine roof bolt hole to prevent spalling or crumbling of the side walls of the interior of the roof bolt hole by use of a large conical stopper-like washer on the shaft of a particular type of roof bolt. U.S. Pat. No. 3,651,651 shows a stabilizing bushing and a flat washer. U.S. Pat. No. 3,521,454 illustrates a flexible annular washer which accommodates variations in the surface surrounding the mouth of a rock bolt hole. However, none of the known rock bolt or roof bolt assemblies provide reliable sealing of the interior of the mine roof bolt hole from mine air in many practical instances. One instance is that the roof bolt, when tightened, or "torqued", may be anchored by expansion of expansion shell in such a way that the lower end of the roof bolt is forced toward one side of the roof bolt hole, preventing the known washers from being reliably utilized. Further, certain of the known washers are not readily adaptable to mine roof bolts and support plates which are nowadays commonly used, particularly roof bolts and corresponding support plates which permit a certain amount of swiveling of the roof bolt shaft with respect to the support plate; this is a highly desirable feature, since roof bolt holes are frequently not perfectly perpendicular to the portion of the mine roof surrounding the mouth of roof bolt holes. Yet, in order to provide adequate functioning of the roof bolt assemblies and to prevent degradation of the interior walls of the roof bolt holes, there exists a need for a reliable washer/gasket which reliably seals the interiors of roof bolt holes from mine air, even though such roof bolt holes are not perpendicular to the surrounding portions of mine roof and even though the roof bolts are misaligned with respect to the roof bolt holes as a result of torquing of the roof bolts. Other United States Patents which generally indicate the state-of-the-art are for rock bolts and mine roof bolts such as U.S. Pat. Nos. 2,950,602; Re 25,869; 2,892,650; 1,960,750; 3,693,359; 3,653,217; and 3,379,016. Another known approach to expelling air from mine roof bolts involves injection of or provision of various resin compounds to fill up roof bolt holes. However, such compounds and the means for providing or installing such compounds within roof bolt holes are unduly expensive.

SUMMARY OF THE INVENTION

Figure 1:
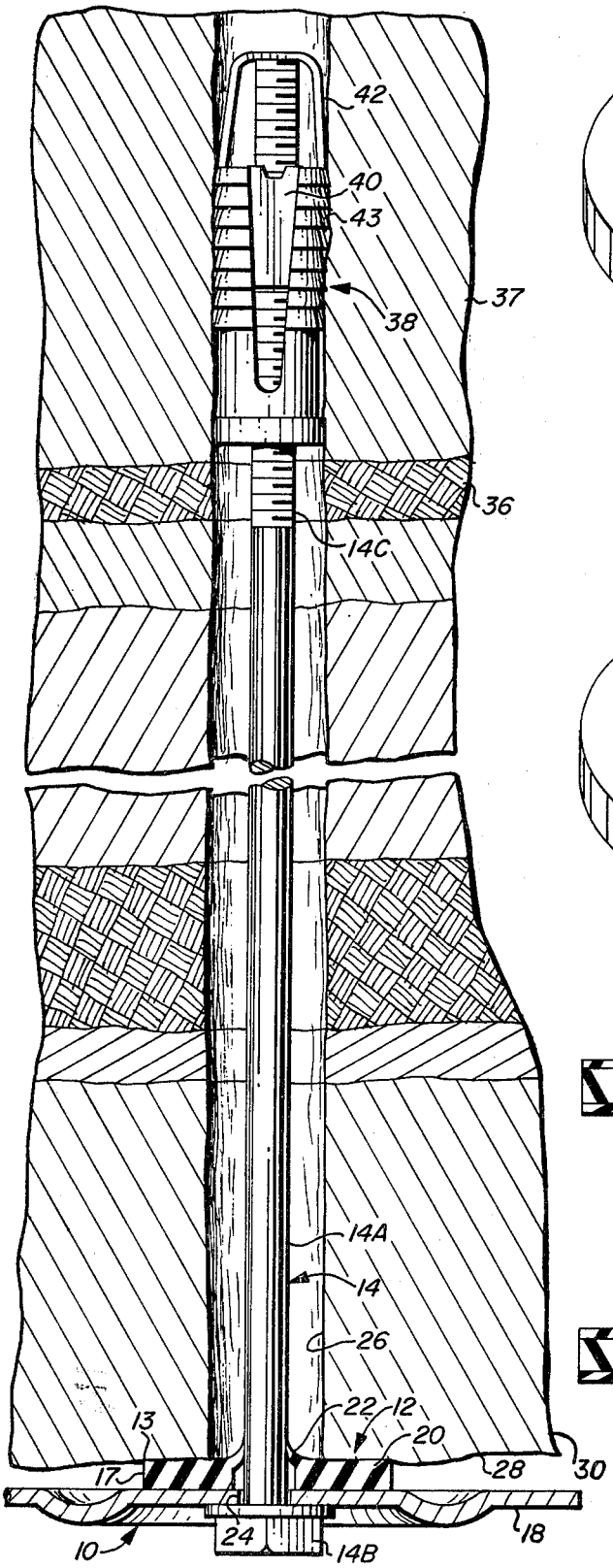
FIG. 1 is a partial sectional view illustrating a mine roof bolt assembly installed in a roof bolt hole through multi-layered mine roof strata.
Figure 2:
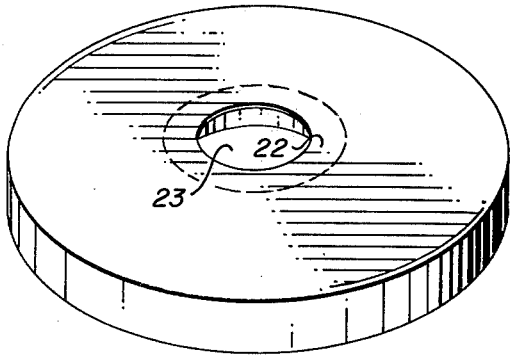
FIG. 2 is a perspective view of a washer/gasket of the invention.
Figure 4:
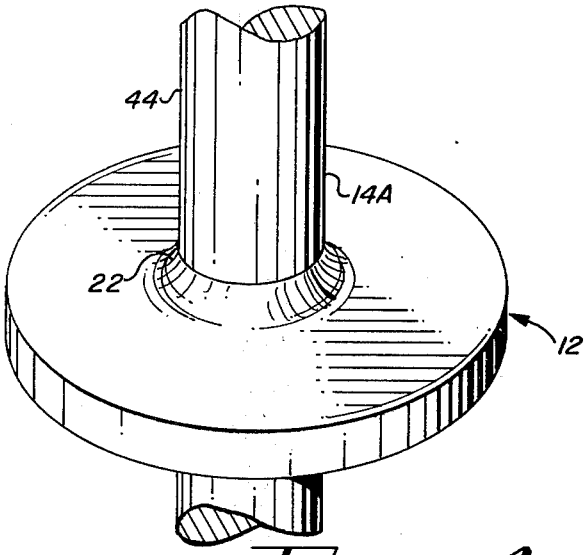
FIG. 4 is a perspective view showing the washer/gasket of FIGS. 2 and 3 being slid along the shaft of the roof bolt.

Accordingly, it is an object of the invention to provide a method and mine roof bolt assembly for reliably sealing the interior of a mine roof bolt hole from ambient mine air.

It is another object of the invention to provide a roof bolt assembly which reliably seals the interior of a roof bolt hole when the roof bolt is misaligned in the roof bolt hole.

It is another object of the invention to provide a washer/gasket for a mine roof bolt assembly which produces an increasingly strong seal to a roof bolt, shaft and a support plate, and the mine roof as the roof bolt is tightened.

It is another object of the invention to provide a mine roof bolt assembly and method to prevent deterioration of certain kinds of layers of mine roof strata due to exposure to moisture and/or oxygen to prevent caving of the mine roof.

It is another object of the invention to provide a mine roof bolt assembly which provides a reliable sealing of the interior of a roof bolt hole from mine air for a roof bolt hole which is oriented at a substantially non-perpendicular angle from the plane of the mouth of the roof bolt hole.

Briefly described, and in accordance with one embodiment thereof, the invention provides a method and roof bolt assembly for reliably sealing the interior of a roof bolt hole from ambient mine air. The roof bolt assembly includes a support plate, a roof bolt extending through a hole in the support plate, a flexible washer/-gasket disposed over a shaft of the roof bolt, and an expansion shell unit installed on a threaded end of the roof bolt. The washer/gasket includes a substantially annular outer portion for sealing the mine roof surrounding the mouth of the roof bolt hole to the support plate. An interior annular portion of the flexible washer forms a seal to the roof bolt shaft. The seals between the flexible washer and the mine roof, support plate and roof bolt shaft are produced when the roof bolt is tightened during installation of the roof bolt assembly. In one embodiment of the invention, the flexible washer/-gasket includes an interior relatively thin flexible sphincter annulus which tightly grips the shaft of the roof bolt to form the seal therewith. The surrounding substantially annular portion of the flexible washer/gasket conforms to variations in the mine roof surrounding the roof bolt hole. The portion of the flexible washer from which the sphincter annulus extends is "squeezed" inward during tightening of the roof bolt, thereby further tightening the gripping of the sphincter annulus to the roof bolt shaft. In one embodiment of the invention the flexible washer is formed from neoprene type rubber having a flexibility parameter in the range from 40 to 80 durometers. In another embodiment of the invention, an interior annular groove dividing an annular portion of the flexible washer into an upper portion and a lower portion is included in the flexible washer. An annular insert having a tapered surface is disposed within the annular groove. The annular insert is also formed from neoprene type rubber. A lubricant is provided between the surfaces of the annular insert and the surfaces of the groove, so that when the roof bolt is tightened, the annular insert is squeezed inwardly to sealingly grip the roof bolt shaft. In another embodiment of the invention, the annular insert is symmetrically split in order to facilitate installation of the separate symmetric parts into the annular groove of the flexible washer. In another embodiment of the invention, an annular washer has a tapered surface and is positioned between the support plate and the lower surface of the washer/gasket so that when the roof bolt is tightened the annular washer is squeezed inwardly to sealingly grip the roof bolt shaft. According to another embodiment of the invention, a thimble is provided over the threaded portion of the roof bolt. The thimble is then removed and the extension shell unit is installed.

DESCRIPTION OF THE INVENTION

The present invention provides several sphincter-type washer/gasket configurations for use in mine roof bolt assemblies to seal the roof bolt hole from the ambient mine atmosphere after the roof bolt assembly is installed in the mine roof. It has been found that certain layers of mine roof strata having a sufficient content of water absorbent clays such as montmorillonites, illites, etc., are very vulnerable to reaction with humid mine air. It has also been found that layers of roof strata containing certain minerals such as pyrite, calcite, etc., react adversely with either oxygen or a combination of moisture and oxygen and become greatly weakened by such reaction. If the roof bolt hole is not reliably sealed from the mine atmosphere, the roof bolt hole exposes the above-mentioned kinds of layers in the roof strata to a continually replenished supply of oxygen and/or water vapor, as subsequently explained. A vapor phase transfer reaction occurs wherein the moisture of the air with the above-mentioned water absorbent clays, or the reaction of the oxygen with the above-mentioned pyrites, calcites, etc. causes the corresponding layers of upper strata to weaken or oxidize. It has been found that as long as the supply of moist air and oxygen is replenished, the deterioration of the above kinds of layers extends laterally, eventually severely degrading the strength of the "laminated" mine roof strata configuration by causing lateral slippage between layers on either side of the degraded layer. The load bearing characteristics of such roof strata are greatly weakened even though the mine roof bolts remain tightly anchored in the upper strata. Diurnal barometric pressure changes, seasonal atmospheric pressure changes, pressure variations caused by pulsations of mine ventilation systems, variation in pressure caused by shooting and blasting, and variations in pressure due to extending and closing of working areas to mine ventilation all cause pressure changes in the ambient mine atmosphere which causes a "breathing" type of air exchange between the interior of roof bolt holes and the outside mine atmosphere if the roof bolt assemblies do not provide airtight sealing between the interior of the roof bolt hole and the mine.

As previously explained, the known roof bolt assemblies do not provide reliable air-tight sealing to prevent the above-mentioned "breathing", thus leaving strata exposed within the roof bolt holes vulnerable to the above-described degradation due to the action of moisture and oxygen "inhaled" by the roof bolt holes.

Referring now to FIG. 1, a roof bolt assembly 10 is shown installed in a roof bolt hole 26 drilled vertically in a mine roof strata containing a plurality of layers, such as 30, 32, 36, 37, each having different mineral characteristics and different structural strengths.

Roof bolt assembly 10 includes roof bolt 14 having a head 14B (which is engageable by a torque wrench), a shaft 14A having a remote threaded end portion 14C. Roof bolt assembly 10 further includes a roof plate or support plate 18 having a centrally located hole 24 therein through which shaft 14A extends. An expansion shell 38 is threadably disposed on threaded portion 14C of shaft 14A, and includes a wedge type nut 40 wedged between two sections of expandable shell portion 43, so that when roof bolt 14 is tightened, wedge nut 40 is drawn into a tapered groove between the opposed portions of shell portion 43, thereby expanding such opposed portions. U-shaped spring number 42 engages the walls of the roof bolt hole to prevent expansion shell 38 from spinning (as the roof bolt 14 is turned) until the opposed portions of shell portion 43 expand sufficiently to engage the wall of the roof bolt hole.

Roof bolt 14, support plate 18, and expansion shell 38 are all readily available devices from manufacturers such as Bethlehem Steel and Pattin Manufacturing Company.

According to the invention, a flexible sealing washer/gasket 12 is provided in roof bolt assembly 10 (which would ordinarily be preassembled at the factory for installation in pre-drilled roof bolt holes in the desired location of a mine). Washer/gasket 12 includes an annular body portion 20 disposed between the upper surface of support plate 18 and the portion of mine roof 28 surrounding the mouth of roof bolt hole 26. (It should be noted that body portion 20 could also be square or have some other configuration of the outer boundary and a substantially round inner boundary. The term "annular" as used with respect to the body portion of a washer/gasket is intended to include such configurations). A relatively thin flexible annular portion 22 extends from the upper surface of washer/gasket 12, as more clearly shown in FIGS. 2–5. Washer/gasket 12 may be formed from a neoprene type synthetic or a EDPM type rubber, manufactured, for example, by U.S. Ruber Co., having a flexibility parameter in the range from approximately 30 to 80 durometers.

As roof bolt 14 is tightened, expansion shell 38 expands, thereby rigidly anchoring roof bolt assembly 10 in strata layer 37. Head 14B of roof bolt 14 presses support plate 18 against washer/gasket 12, thereby "squeezing" it to conform to slight variations in the mine roof 28 surrounding the mouth of roof bolt hole 26 to form an air-tight seal between mine roof 28 and support plate 18.

Figure 3:
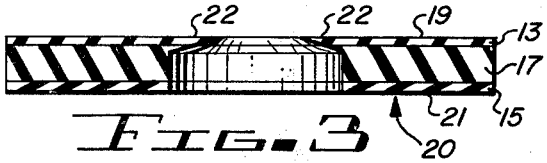
FIG. 3 is a sectional view of another embodiment of the invention.
Figure 5:
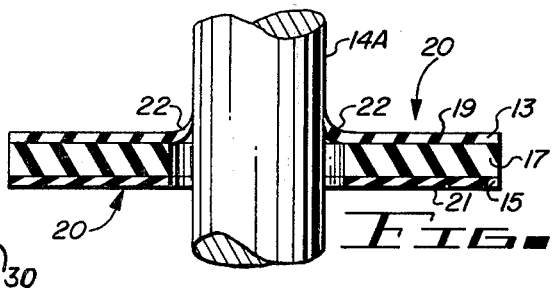
FIG. 5 is a partial sectional view of an embodiment of the invention.

The diameter of opening 23 (FIG. 2) is sufficiently less than the diameter of shaft 14A that sphincter type annular region 22 tightly grips shaft 14A to produce an air-tight seal therewith. The compression of body 20 of washer/gasket 12 squeezes material of body 20 inward, causing a "spincter-type" contraction, further squeezing annulus 22 against the shaft 14A, improving the quality of the seal therewith. Sphincter type annulus 22 may be integrally formed with body 20, or may be the interior portion of a laminated upper layer 13 formed on the upper surface of annular body 20, as indicated in FIGS. 3 and 5. As indicated in FIGS. 3 and 5, a bottom laminated layer 15 may also be provided on the lower surface of annular body 20 to form a seal with the upper surface of support plate 18. A central portion 17 of body 20 can be formed of a different material than layers 13 and 21, such material being especially suited to accommodating variations and irregularities in the structure of the surface of the portion of mine roof 28 surrounding the mouth of roof bolt hole 26.

If, in the course of tightening roof bolt 14, expansion shell 38 expands and anchors roof bolt assembly 10 in layer 37 in such a way that expansion shell 38 tilts, forcing roof bolt 14 sideways so that it is not aligned with the central axis of roof bolt hole 14. (Roof bolt 14 is so rigid that it cannot be bent or sprung to compensate for such misalignment.) Washer/gasket 12 has a sufficiently large diameter that a reliable seal between support plate 18 and sealing 28 is formed regardless of such misalignment.

Figure 10:
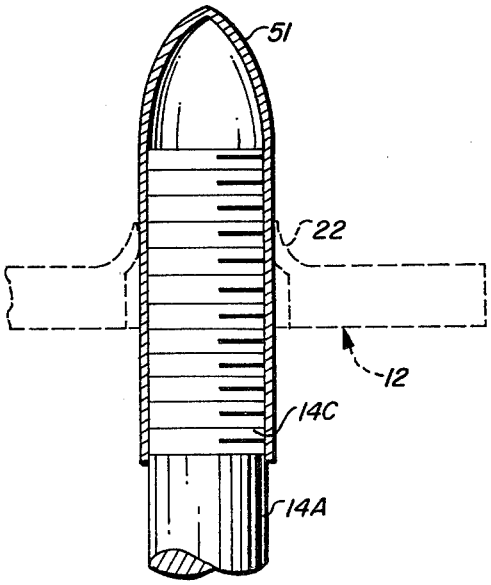
FIG. 10 is a partial sectional view illustrating a thimble utilized for installing a washer/gasket during manufacture of a roof bolt assembly according to the invention.

As indicated in FIG. 10, a washer/gasket threading thimble 51 can be temporarily positioned over the threaded portion 14C of roof bolt 14 to facilitate sliding of washer/gasket 12 over the threads of roof bolt 14 without damage to sphincter-type annulus 22.

Figure 6A:
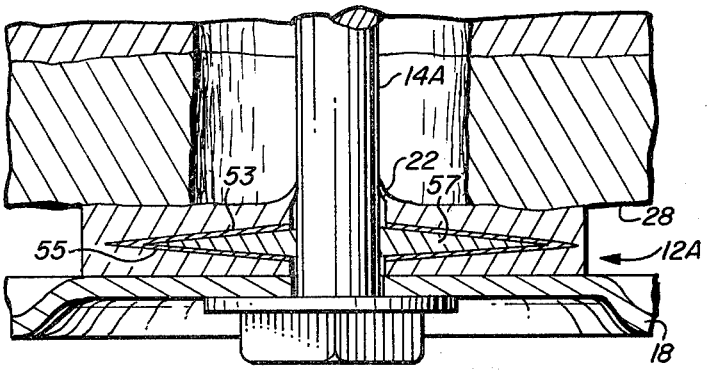
FIG. 6A is a sectional view of an alternate gasket installed in a mine roof bolt assembly.

FIG. 6A shows a sectional view of an alternate embodiment of a washer/gasket of the invention, wherein washer/gasket 12A includes an interior annular groove extending around the interior annular portion of annular body of washer/gasket 12A. Annular groove 53 has a tapered surface 55. Annular groove 53 thus separates an inner annular portion of body 20A into an upper portion and a lower portion. A tapered annular insert 57 is disposed within annular groove 53, as shown in FIG. 6A. A suitable lubricant, such as a commercially available silicone lubricant, is provided between the surfaces of annular groove 53 and the surfaces of insert 57. The central opening in insert 57 is large enough to accommodate shaft 14A. When roof bolt 14 is torqued, support plate 18 compresses washer/gasket 12A, insert 57 is squeezed inward and caused to tightly contract against the grip shaft 14A, thereby providing an improved seal therewith. The silicone lubricant greatly reduces friction, thereby increasing the inward force component exerted on insert 57, increasing the gripping to shaft 14A and thereby increasing the strength of the seal formed therewith. Annular insert 57 may be formed of rubber-like material such as the above-mentioned neoprene type synthetic rubber, or a soft elastomer having a durometer rating of approximately 20.

Figure 6B:
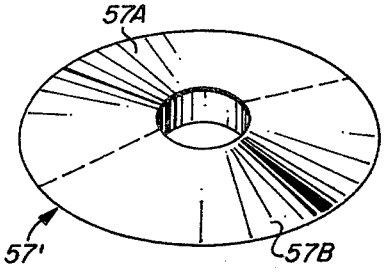
FIG. 6B is a perspective view of an insert washer utilized in the washer/gasket of FIG. 6A.

An alternate configuration of insert 57 as shown in FIG. 6B, wherein insert 57 is composed of two symmetrical segments 57A and 57B. This configuration is more easily installed in annular groove 53 during manufacturing of composite washer/gasket 12A, which, being composed of flexible neoprene rubber, may be bent in order to facilitate separately inserting portions 57A and 57B of insert 57' into groove 53. The inward force on insert 57 caused by compression between mine roof 28 and support plate 18 tightly seals the portions 57A and 57B, so that a reliable seal to shaft 14A is formed.

Figure 7:
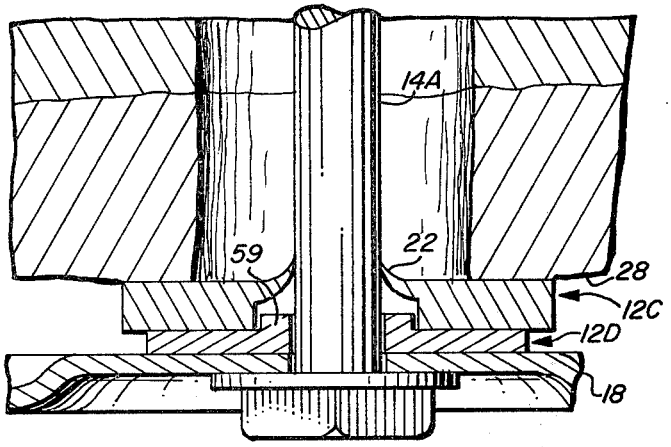
FIG. 7 is a partial sectional view of another washer/gasket configuration according to the invention.

FIG. 7 shows another alternate embodiment of the invention, wherein washer/gasket 12C and an underlying washer/gasket 12D are compositely disposed about shaft 14A. Both sphincter-type annulus 22 and the interior enlarged portion 59 of washer/gasket 12D forms a seal with shaft 14A. As roof bolt 14 is tightened, support plate 18 tightly compresses washer/gaskets 12C and 12D together. The configuration shown in FIG. 7 is such that during compression, lower washer/gasket 12D is forced inwardly to tightly grip and seal to shaft 14A.

Figure 8:
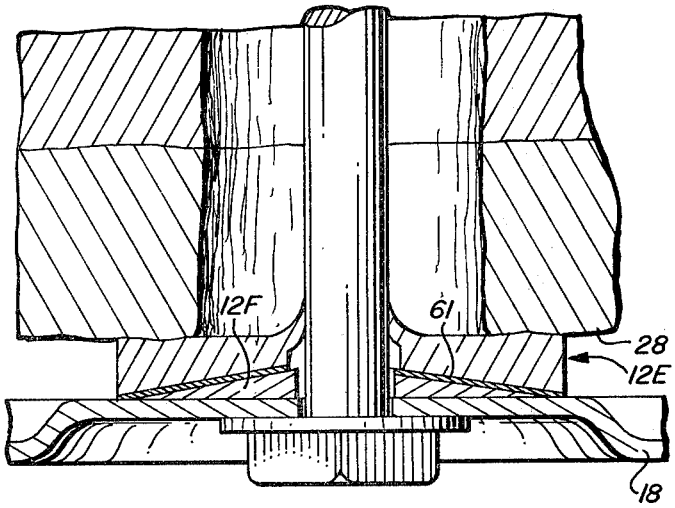
FIG. 8 is a partial sectional view of another washer/gasket configuration according to the invention.

Another embodiment of the invention is shown in FIG. 8, wherein a lower washer/gasket 12F having a tappered upper surface and upper washer/gasket 12E having a tappered lower surface together form a composite washer/gasket. A silicon lubricant is provided between washer/gaskets 12E and 12F to reduce friction, so that when the roof bolt 14 is tightened, lower washer/gasket 12F is forced inward to form a tight seal with shaft 14A.

In the embodiments of FIGS. 6A, 7, and 8, insert 57 and lower washer/gaskets 59 and 61 may be formed of a neoprene type rubber material having a different degree of harness than the upper washer/gasket portions. For example, a somewhat softer neoprene type rubber material may be utilized to form a seal with shaft 14A.

Figure 9:
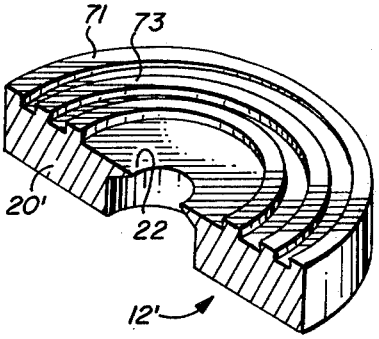
FIG. 9 is a partial perspective drawing of an alternative washer/gasket configuration.

Referring now to FIG. 9, washer/gasket 12' includes a plurality of ridges 71, 73, etc. formed on the upper surface thereof. One or more such ridges are provided to increase the inward contraction or squeezing of the inner portion of annular body 20' during compression thereof between support plate 18 and mine roof 28, causing tighter contraction of sphincter type annulus 22 about shaft 14A. Ridges 71, 73, etc. further improve the accommodation and sealing of sphincter/washer 12' to irregularities (such as small "peaks" and "valleys") in the surface of mine roof 28 surrounding the roof bolt hole in which roof bolt assembly 10 is installed.

The various configurations of washer/gaskets for mine bolt assemblies disclosed and described above provide substantially more reliable sealing of the interior of a roof bolt hole from ambient mine atmosphere for presently conventional mine roof bolts and support plates, even though such roof bolts may become substantially misaligned with the roof bolt holes upon torquing of the roof bolts during installation. Substantially more reliable sealing is also obtained if the roof bolt holes are not substantially perpendicular to the portion of the mine roof surrounding the roof bolt holes.

We claim:

1. A mine roof bolt assembly for supporting a mine roof, said mine roof bolt assembly comprising in combination:

(a) a roof bolt having a shaft;

(b) support plate means engaged by said roof bolt for applying supporting force against a portion of said mine roof;

(c) expansion means engaging an upper end of said mine roof bolt for expanding against an interior wall of a roof bolt hole to anchor said mine roof bolt assembly; and (d) flexible washer means disposed around a shaft of said roof bolt between said support plate means and said mine roof for sealing said mine roof to said support plate means to prevent ambient mine air from entering into said roof bolt hole while said mine roof bolt assembly remains installed in said mine roof, thereby preventing degrading of layers of strata above said mine roof by said ambient mine air, said washer means including a substantially annular body portion and a sphincter means extending inwardly from said body portion against said shaft, said substantially annular body portion having a pair of opposed substantially parallel surfaces, one for engaging said support plate means and one for engaging said mine roof, said annular sphincter means being substantially coplanar with said substantially annular body portion, flexible and extending inwardly from said body toward the roof bolt shaft to increase the pressure of said sphincter means against said shaft of said roof bolt in response to compressing of said substantially annular body portion of said washer means between said support means and said mine roof around said roof bolt hole as said roof bolt is tightened, thereby increasing the sealing action of said sphincter means against said shaft of said roof bolt as said roof bolt is tightened against said support plate means, said annular sphincter means including a flange thinner than said substantially annular body portion extending inwardly from said substantially annular body portion, said substantially annular sphincter means having a center hole having a diameter less than the diameter of said roof bolt shaft, said substantially annular body portion having an inside diameter which is substantially greater than the diameter of said roof bolt shaft.

2. The mine roof bolt of claim 1 wherein said body portion is formed of neoprene rubber material.

3. The mine roof bolt assembly of claim 2 wherein said body has a flexibility parameter in the range from 35 to 80 durometers.

4. The mine roof bolt of claim 2 wherein said annular sphincter means includes an interior annular groove dividing an upper annular portion of said body from a lower annular portion of said body and further including a flexible annular insert disposed in said groove, said annular insert being squeezed inwardly to sealingly contact said roof bolt shaft in response to said compressing.

5. The mine roof bolt assembly of claim 4 wherein the thickness of said insert decreases toward the outer boundary of said insert.

6. The mine roof bolt assembly of claim 5 further including a lubricant disposed in said groove between said insert and said upper and lower annular portions.

* * * * *